US006050401A

United States Patent [19]

Michaelson

[11] Patent Number: 6,050,401

[45] Date of Patent: Apr. 18, 2000

[54] STORAGE ASSEMBLY FOR TOILET TISSUE AND TOILET BOWL BRUSH

[75] Inventor: Ward Michaelson, Coram, N.Y.

[73] Assignee: Creative Bath Products, Inc., N.Y.

[21] Appl. No.: 09/396,240

[22] Filed: Sep. 15, 1999

[51] Int. Cl.[7] ..... B65D 85/67

[52] U.S. Cl. ..... 206/225; 206/361; 206/394

[58] Field of Search ..... 206/225, 226, 206/233, 576, 361, 15.2, 15.3, 391, 394

[56] References Cited

U.S. PATENT DOCUMENTS

| | | | |
|---|---|---|---|
| 3,275,133 | 9/1966 | Wood . | |
| 4,273,392 | 6/1981 | Stinson . | |
| 4,432,451 | 2/1984 | Hooser . | |
| 5,040,679 | 8/1991 | Rehmann | 206/225 |
| 5,924,566 | 7/1999 | Gibbs | 206/15.3 |
| 5,941,379 | 8/1999 | Barardo | 206/361 |
| 5,971,141 | 10/1999 | Shafik | 206/225 |

*Primary Examiner*—Jacob K. Ackun
*Attorney, Agent, or Firm*—Anthony J. Casella; Gerald E. Hespos

[57] ABSTRACT

A storage assembly is provided for convenient concealment of a toilet bowl brush and rolls of toilet tissue. The assembly includes a bowl brush removably supported in a bowl brush with the brush handle extending vertically upwardly. A toilet tissue holder is provided with a flat annular bottom wall and at least a hollow spindle extending upwardly from the bottom wall. The spindle is telescoped over the brush handle and is dimensiond to have rolls of toilet tissue telescoped thereon. A cover is provided for covering at least the top end of the toilet tissue stacked on the tissue holder. A sidewall surrounds the stacked rolls of toilet tissue and is connected to either the cover or the bottom wall of the tissue holder.

12 Claims, 9 Drawing Sheets

STORAGE ASSEMBLY FOR TOILET TISSUE AND TOILET BOWL BRUSH

BACKGROUND OF THE INVENTION

1. Field of the Invention

The subject invention relates to a storage assembly for storing several rolls of toilet tissue and a toilet bowl brush.

2. Description of the Related Art

A well equipped bathroom should have at least one spare role of toilet tissue and a brush for periodically cleaning a toilet bowl. Although both the toilet tissue and the brush are very useful, neither is considered to be aesthetically attractive. Most homeowners will sacrifice either convenience or aesthetics. In particular, convenience may be sacrificed for the sake of aesthetics by storing extra toilet tissue and/or the toilet bowl brush at a remote inconspicuous location. Alternatively, aesthetics may be sacrificed by storing extra toilet tissue and a brush in visually obtrusive positions near the bowl.

The prior art has included many attempts to conveniently and unobtrusively store extra rolls of toilet tissue. For example, U.S. Pat. No. 3,275,133 shows a cylindrical canister with a circular cover. The cover is connected to side strips which extend to a bottom disc. Rolls of toilet tissue can be supported on the bottom disc between the strips and beneath the cover. These rolls of toilet tissue can be accessed by lifting the cover and sliding the toilet tissue transversely out of the space between the opposed strips. The canister shown in U.S. Pat. No. 3,275,133 can be considerably more attractive than a loose array of toilet tissue rolls. However, the toilet tissue rolls can easily spill from the assembly when the cover is lifted. Additionally, the canister of U.S. Pat. No. 3,275,133 does not provide for convenient storage of a toilet bowl brush.

U.S. Pat. No. 4,273,392 shows a canister similar to the canister in the above-described U.S. Pat. No. 3,275,133. In this instance, however, the toilet tissue is mounted over a rod that has a plate at one end which is larger than the inside diameter of the roll of toilet tissue. The opposed end of the rod has a chain connected thereto which can be gripped to lift the rod and toilet tissue stored on the rod. The assembly shown in U.S. Pat. No. 4,273,392 would not facilitate the convenient, but aesthetically attractive, storage of a toilet bowl brush. Additionally, the chain at the top end of the rod would be difficult to thread through the tube on which the toilet tissue is wound. The chain also would be awkward to lift.

U.S. Pat. No. 4,432,451 shows a bathroom accessory for storing both extra rolls of toilet tissue and a bathroom plunger. The accessory includes a split cylinder with an open top, an open bottom and a slot along one longitudinal side. A bottom tray is secured in the cylinder at a location spaced upwardly from the open bottom. The bottom tray includes a central aperture dimensioned to slideably receive the handle of the plunger. The accessory further includes an intermediate tray slideably received in the cylinder at a location above the bottom tray. The intermediate tray also includes a central aperture through which the handle of the plunger can be slid. The intermediate tray further includes a tab that projects through an elongate slot in the sidewall of the split cylinder. The plunger can be supported on the floor with the handle projecting vertically upwardly. The split cylinder then is telescoped over the plunger such that the handle of the plunger projects through the holes in the trays. The rolls of toilet tissue then can be dropped into the cylinder and over the handle of the plunger. The cover then is placed over the open top of the split cylinder and over the handle of the plunger. The toilet tissue can be accessed by lifting the tab on the intermediate tray to elevate the toilet tissue sufficiently to be accessed. The arrangement shown in this patent conveniently hides the plunger. However, the plunger is easily self-supporting and is seldom used. The apparatus shown in this patent would not conveniently support a brush with a rounded array of flexible bristles. Additionally, the arrangement of the tray and tab projecting through the slot complicates the lifting of the several rolls of toilet tissue on the tray and provides for an aesthetically unattractive view of the toilet tissue and plunger handle stored in the split cylinder.

U.S. Pat. No. 1,700,265 shows a carrier for rolls of toilet tissue. The carrier does not conceal the toilet tissue and has no structure that would accommodate a toilet bowl brush.

U.S. Pat. No. 5,040,679 shows an assembly having a plunger mounted on its base. Toilet tissue then is slid over the handle of the plunger. A doll with a skirt is mounted over the end of the handle such that the skirt extends over the opposed end of the plunger and the toilet tissue mounted on the handle. As with the device shown in the preceding patent, this patent would not provide convenient storage for a toilet brush bowl.

U.S. Pat. No. 5,456,356 shows a cover for concealing a plunger. Toilet tissue can be telescoped over the handle of the cover. The vertical array of toilet tissue rolls is aesthetically very unattractive. Additionally, this patent has no structure for supporting a toilet brush bowl.

In view of the above, it is an object of the subject invention to provide a storage assembly that conveniently stores a toilet bowl brush and a plurality of rolls of toilet tissue.

It is a further object of the subject invention to provide an assembly that conceals both a toilet brush bowl and a plurality of rolls of toilet tissue.

SUMMARY OF THE INVENTION

The subject invention is directed to a toilet bowl brush and toilet tissue storage assembly. The assembly comprises a toilet bowl brush having an elongate handle and a brush at one end of the handle. The brush may comprise an array of outwardly extending bristles. The locus of points defined by the ends of the bristles may form a hemispherical surface that may lead into a generally cylindrical surface. The bristles are flexible, but are sufficiently stiff to properly clean a toilet bowl. Additionally, as explained further below, the cylindrical array of bristle ends provide sufficient stability to hold the brush in a substantially erect condition when the bristles are inserted into a receptacle with a shape that conforms to the locus of the ends of the bristles. The handle of the brush preferably is substantially cylindrical along most of its length, but may be slightly enlarged and/or non-cylindrical at the end remote from the bristles to facilitate gripping. The handle defines a maximum diameter less than the inside diameter of the tube on which a roll of toilet tissues is wound. For example, the handle preferably defines a maximum diameter of about 0.75 inch. The handle also preferably defines a length greater than twice the length of the tube on which a roll of toilet tissue is wound. Thus, for example, the portion of the handle extending from the bristles may define a length of about 11 inches.

The assembly further comprises brush base. The brush base includes substantially concentric inner and outer walls and a top wall extending rigidly therebetween. The outer wall may be substantially cylindrical and defines a diameter greater than the outside diameter of a full roll of toilet tissues. The inner wall includes an inwardly facing surface having a shape that substantially conforms to the shape defined by the locus of the ends of the bristles on the brush. Thus, in a preferred embodiment, the inner surface of the inner wall includes a cylindrical portion substantially adjacent the top wall and an approximately hemispherically generated lower portion having a diameter substantially equal to the diameter of the cylindrical top portion. The inner wall may further include a small cylindrical liquid trap projecting downwardly for accumulating any droplets of water that may be on the bristles of the brush. The top wall of the brush base is generally annular and preferably tapers downwardly toward the inner wall. Thus, the top wall helps to guide a brush into the receptacle defined by the inner wall and further permits a gravitational flow of droplets of water from the top wall into the inner wall. An annular step may be defined at the interface of the top wall and the outer wall.

The assembly further comprises a toilet tissue support. The toilet tissue support includes a generally planar annular bottom wall. The bottom wall may define an outside diameter approximately equal to the outside diameter defined by a full roll of toilet tissue. Additionally the outside diameter of the bottom wall preferably is no greater than the outside diameter of the outer wall of the brush base. The annular bottom wall further includes an inside diameter that is greater than the diameter of the brush handle and less than the inside diameter of the tube on which a roll of toilet tissue is wound.

The toilet tissue support further includes a generally cylindrical hollow spindle projecting concentrically from portions of the bottom wall adjacent the inner circumference thereof. The spindle preferably defines an inside diameter greater than the maximum diameter of the brush handle and an outside diameter slightly less than the inside diameter of the tube of a roll of toilet tissue. The spindle further defines a length that preferably is equal to or slightly greater than twice the length of the tube on which a roll of toilet tissue is wound. The end of the spindle remote from the bottom wall may be open or closed. A closed top end of the spindle can be achieved by molding or by a separate cap securely mounted to the top end of the spindle.

In certain embodiments, the toilet tissue support may further include a generally cylindrical outer wall projecting upwardly from outer circumferential portions of the bottom wall. The outer wall may be substantially concentric with the spindle and may define a length substantially equal to the length of the spindle. The outer wall may project downwardly slightly beyond the bottom wall of the toilet tissue support. The dimensions of downwardly extending portions of the outer wall may substantially correspond to dimensions of the above described step formed at the intersection of the top wall and outer wall of the brush base. Thus, the downwardly extending portion of the toilet tissue support can be telescoped over and nested with the step on the brush base. To achieve this telescoped interfit, the brush handle may be telescoped into and/or through the hollow spindle of the toilet tissue support. The top end of the outer wall of the toilet tissue support may also be characterized by an annular step extending thereabout.

The assembly may further comprise a cover for covering the rolls of toilet tissue mounted over the spindle and/or for covering the brush. The cover preferably includes a cylindrical wall for telescoped disposition over the toilet tissue on the support. The cover may further include a top wall for covering the toilet tissue and/or brush. On embodiments where the toilet tissue support has an outer wall, the cylindrical wall of the cover may have a very short axial length and may include a step for telescoped engagement with the annular step on the top of the outer wall. In embodiments where the toilet tissue support has no outer wall, the cylindrical wall of the cover may define a length approximately equal to or slightly greater than the length of two tubes on which toilet tissue is wound.

The top wall of the cover may be substantially continuous at all locations thereon. Additionally, the top wall may be generally dished or hemispherically generated. In other embodiments, the top wall of the cover may include a central aperture through which top portions of the spindle or brush may extend.

The assembly can be used in several ways. In all possible ways of using the assembly, the bristles of the brush are supportingly received within receptacle defined by the inner wall of the brush base. As noted above, the inner wall defines a shape for closely accommodating the locus of points defined by the ends of the bristles. Thus, the handle of the brush will extend vertically upwardly from the brush base. The toilet tissue support then may be mounted over the brush and the brush base such that the bottom wall of the toilet tissue support engages on the top wall of the brush base, and such that the spindle of the toilet tissue support telescopes over and surrounds the handle of the brush. In certain embodiments, the closed end of the spindle may completely cover the handle of the toilet bowl brush. In other embodiments, however, the handle of the toilet bowl brush may project upwardly beyond the spindle. At least one and preferably at least two full roles of toilet tissue then may be telescoped over the spindle and in supporting engagement on the bottom wall of the toilet tissue support. The cover then may be mounted over the toilet tissue support for protectively enclosing the toilet tissue therein and for providing desirable aesthetic concealment. In certain embodiments, the cover may include an outer wall that surrounds the toilet tissue. In other embodiments, however, the toilet tissue is surrounded by the outer wall of the toilet tissue support and the cover merely functions to cover the top ends of the toilet tissue and/or the top end of the handle of the brush.

Although the toilet tissue and the toilet brush can be conveniently stored in the above-described assembly, it is possible to separate parts of the assembly for separate support and storage. For example, the toilet brush can be supported in the toilet brush support at one location in or near a bathroom, while the rolls of toilet tissue can be stored and concealed within the toilet tissue carrier.

DETAILED DESCRIPTION OF THE PREFERRED EMBODIMENTS

Figure 1:
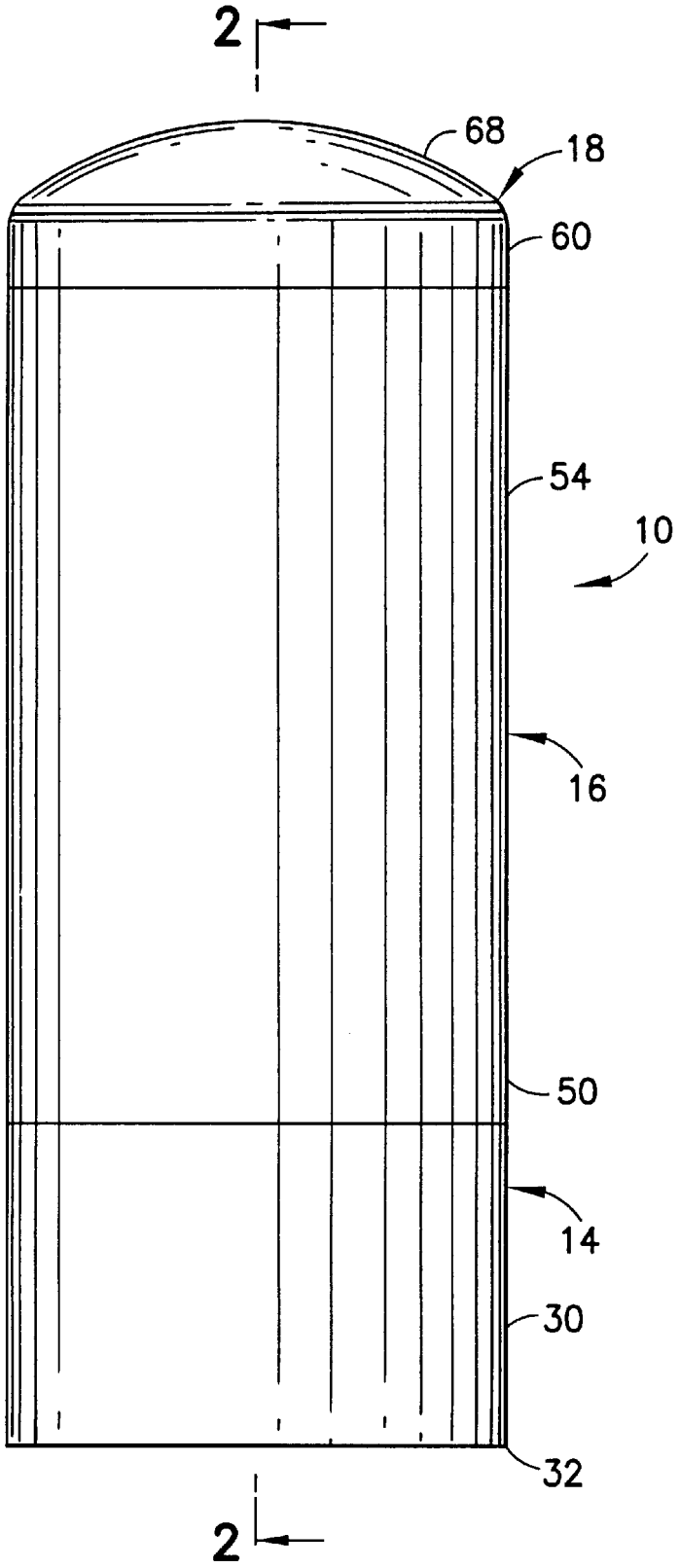
FIG. 1 is a side elevational view of a storage assembly in accordance with the subject invention.
Figure 2:
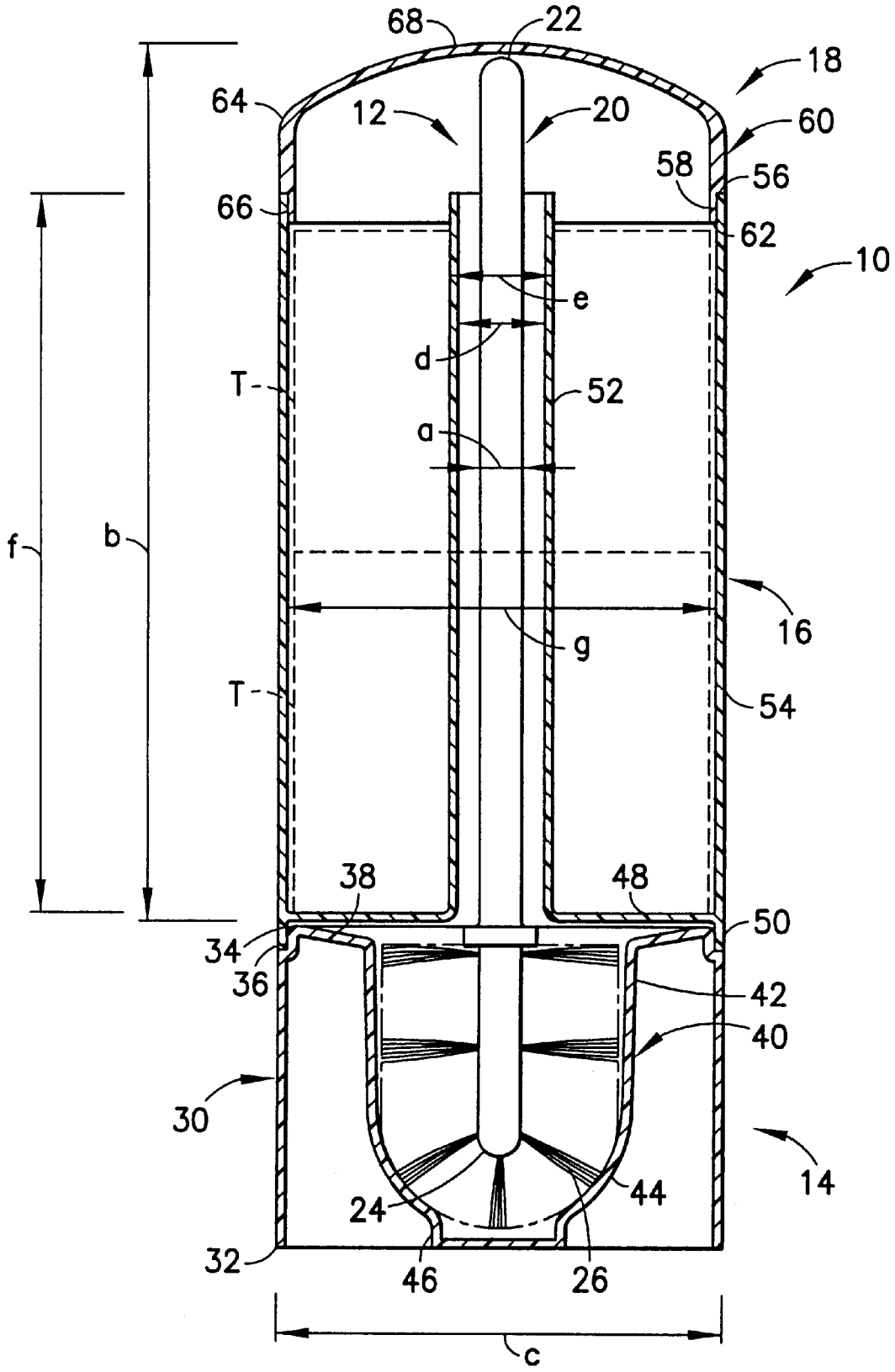
FIG. 2 is a cross-sectional view taken along line 2—2 in FIG. 1.
Figure 3:
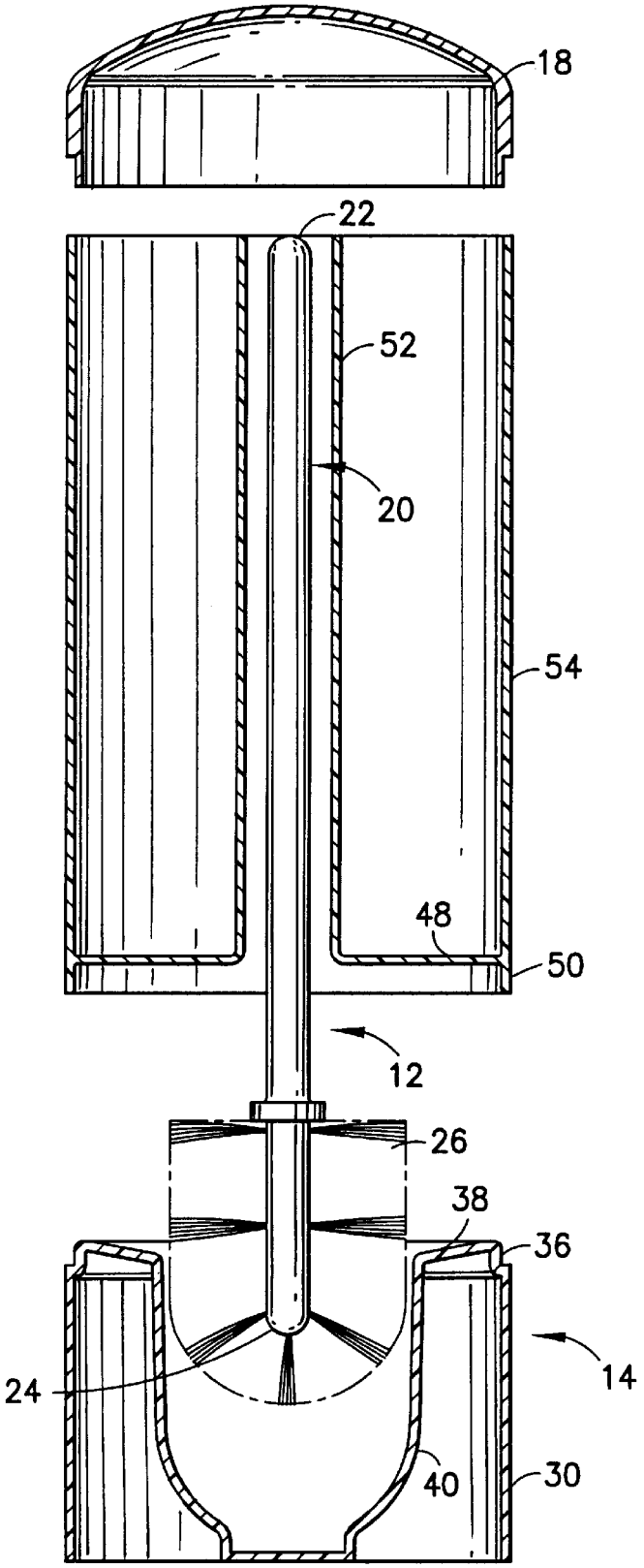
FIG. 3 is an exploded cross-sectional view of the storage assembly shown in FIGS. 1 and 2.
Figure 4:
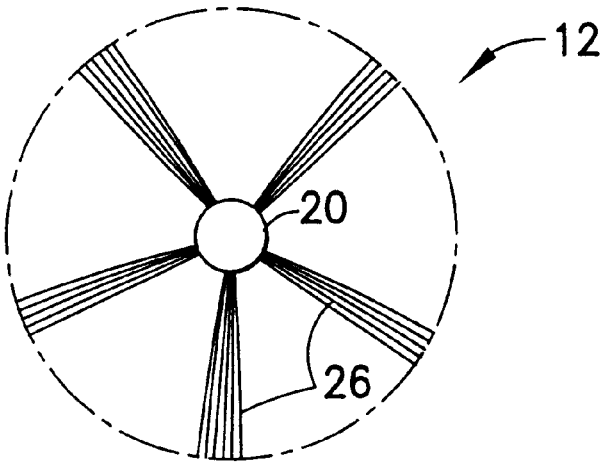
FIG. 4 a top plan view of the brush shown in FIGS. 2 and 3.
Figure 5:
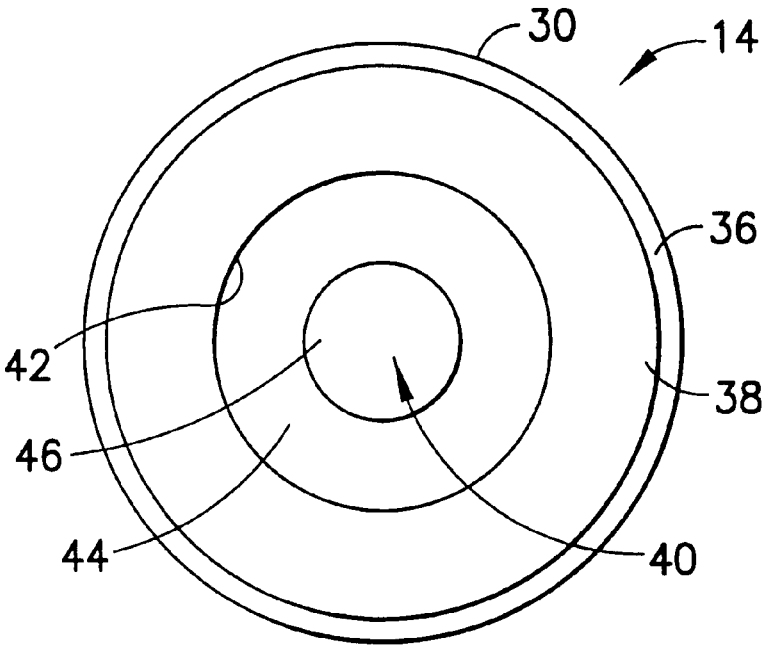
FIG. 5 is a top plan view of the brush base.

A first embodiment of a storage assembly in accordance with the subject invention is identified generally by the numeral 10 in FIG. 1. The assembly 10 includes a toilet bowl brush 12, a bowl brush base 14, a toilet tissue holder 16, and a cover 18.

The toilet bowl brush 12 includes an elongate handle 20 having opposed first and second ends 22 and 24. An array of bristles 26 extends outwardly from portions of the handle 20 in proximity to the second end 24. The bristles 26 are arranged in tufts and are securely mounted in apertures formed in and near the second end 24 of the handle. Bristles most distant from the first end 22 are arranged such that the ends of the bristles 26 define a generally hemispherical locus of points. The bristles 26 closer to the first end 22 define a locus of points that is generally cylindrical. The bristles 26 in proximity to the second end 24 of the handle 20 are flexible but exhibit sufficient rigidity to clean a toilet bowl efficiently without scratching. This rigidity contributes to the ability of the toilet bowl brush 12 to be supported with the handle 20 aligned substantially vertically as explained further herein. Portions of the handle 20 between the bristles 26 and the first end 22 define a maximum diameter "a" that is less than the inside diameter of a tube on which toilet tissues are rolled. More particularly, the diameter "a" of the handle 20 preferably is no more than 0.75 inch. Portions of the handle 20 between the bristles 26 and the first end 22 of the handle 20 define a length "b" that exceeds the combined length of two tubes on which toilet tissue is rolled. For example, the dimension "b" may be approximately 11 inches.

The bowl brush base 14 is unitarily molded from a plastic material and includes a generally cylindrical outer wall 30 with a bottom end 32 and an opposed top end 34. The outer wall 30 defines an outside diameter "c" which is slightly greater than the outside diameter of a full roll of toilet tissue. Additionally, portions of the cylindrical outer wall 30 in proximity to the top end 34 define a reduced diameter step 36. An annular top wall 38 extends inwardly from the top end 34 of the outer wall 30. The top wall 38 preferably is tapered downwardly at locations inwardly from the outer sidewall 30. An inner wall 40 extends downwardly from innermost portions of the top wall 38 and is substantially concentric with the outer wall 30. The inner wall 40 includes a cylindrical portion 42 near the top wall 38 and a generally hemispherical portion 44 closer to the bottom end 32 of the outer wall 30. The inner wall is dimensioned and configured to define a receptacle that closely conforms with the locus of points defined by the outer ends of the bristles 26 on the brush 12. The inner wall 40 further is characterized by a trap 46 at a central bottom portion thereof. The trap 46 is provided to accumulate any liquid that drips off the bristles 26 of the brush 12. Thus, the bristles 26 will be spaced from any such liquid to prevent mold or mildew accumulating on the bristles 26 during periods of storage.

The toilet tissue holder 16 includes a planar annular bottom wall 48 having an outside diameter approximately equal to the outside diameter "c" of the outer wall 30 of the bowl brush base 13. The bottom wall 48 of the toilet tissue holder 16 further includes an inside diameter which is greater than the maximum diameter "a" of the handle 20 of the toilet bowl brush 12. A lip 50 projects downwardly from the outer circumference of the bottom wall 48. The lip 50 has an outside diameter "c" conforming to the outside diameter of the outer side wall 30 of the bowl brush base 14. The lip 50 further defines an inside diameter conforming to the diameter of the step 36 at the top end 34 of the outer sidewall 30 on the bowl brush base 14.

The toilet tissue holder 16 further includes a hollow cylindrical spindle 52 extending perpendicularly upwardly from the inner most portions of the bottom wall 48. The hollow cylindrical spindle 52 is concentric with the annular bottom wall 48 and defines an inside diameter "d" which exceeds the outside diameter "a" of the handle 20 on the toilet bowl brush 12. Additionally, the spindle 52 defines an outside diameter "e" that is less than the inside diameter of the tube on which a roll of toilet tissue is wound. The spindle 52 further defines an axial length "f" that is equal to or slightly greater than twice the length of the tube on which a roll of toilet tissue is wound. Thus, two rolls of toilet tissue can be telescoped over the spindle 52 and supported on the bottom wall 48.

The tissue holder 16 further includes a cylindrical outer wall 54 that extends upwardly from the outer circumference of the bottom wall 48 substantially concentrically with the spindle 52. The cylindrical outer wall 54 has an outside diameter substantially equal to the outside diameter "c" of the outer wall 30 on the bowl brush base 14. Additionally, the outer cylindrical wall 54 of the tissue holder 16 further defines an inside diameter "g" which is slightly greater than the outside diameter of a full roll of toilet tissue. Thus, two rolls of toilet tissue can be telescoped over the spindle 52 of the tissue holder 16 and within the cylindrical outer wall 54 thereof. The cylindrical outer wall 54 includes a top end 56 having an inwardly facing circumferential step 58 with an inside diameter slightly less than "c".

The cover 18 includes a short cylindrical sidewall 60 having a bottom end 62 and a top end 64. Portions of the cylindrical sidewall 60 of the cover 18 adjacent the bottom end 62 define a step 66 having an outside diameter that is slightly less than the inside diameter of the step 58 formed in the outer cylindrical wall 54 of the tissue holder 16. The step 66 is diametrically dimensioned to telescope within the internal step 58 formed on the top 56 of the outer cylindrical wall 54 of the tissue holder 16. Portions of the cylindrical wall 60 of the cover 18 adjacent the top end 64 thereof define an outside diameter "c" substantially conforming to the outside diameter of the outer cylindrical wall 54 of the tissue holder 16. The cover 18 further includes a dome-like top wall 68 extending across the top end 64 of the cylindrical sidewall 60 of the cover 18.

Figure 6:
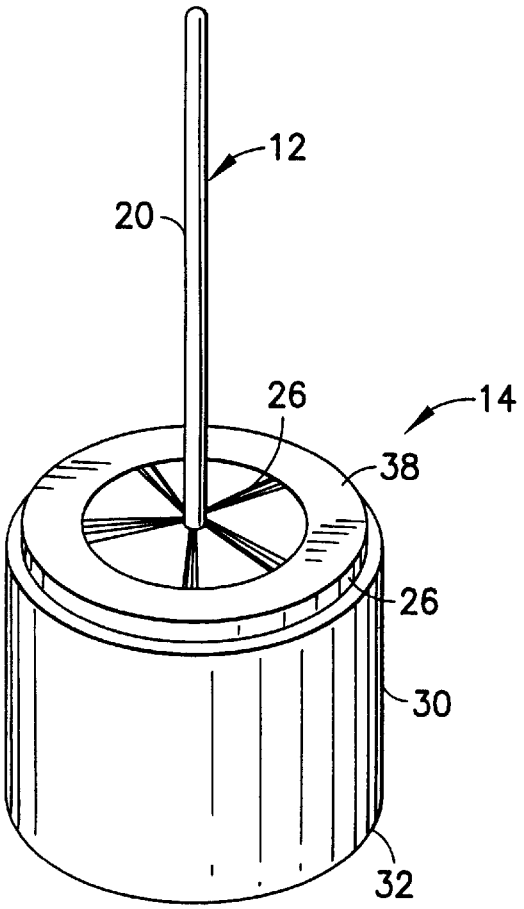
FIG. 6 is a perspective view of the toilet brush and brush base.

The storage assembly 10 is employed by positioning the bristles 26 at the second end 24 of the handle 20 of the brush 12 in the receptacle defined by the inner wall 42 of the bowl brush base 14. The comparable dimensions of the inner wall 42 and the locus of points defined by the outer ends of the bristles 26 efficiently holds and supports the brush 12 with the handle 20 being substantially vertically erect. A slight taper in the top wall 38 of the bowl brush base 14 guides the brush 12 into the receptacle formed by the inner wall 40 and also channelizes any stray drops of water inwardly. Stray drops of water then are collected by the trap 46 at the bottom of the inner wall 40. The combination of the toilet bowl brush 12 and the bowl brush base can be used separately if desired, as shown in FIG. 6. However, in a typical application, the tissue holder 16 is mounted over the brush 12 and onto the bowl brush base 14. In particular, the spindle 52 of the tissue holder 16 is telescoped over the handle 20 of the brush 12 sufficiently for the bottom wall 48 of the tissue holder 16 to be supported on the top wall 38 of the bowl brush base 14. In this supported position, the lip 50 that extends downwardly from the bottom wall 48 will telescope over and engage the step 36 at the top end 34 of the outer sidewall 30 on the bowl brush base 14. Thus, the outer cylindrical wall 54 of the tissue holder 16 will substantially register with the outer wall 30 of the base 14 to define a substantially continuous vertically oriented cylinder. Two rolls of toilet tissue "T" then can be telescoped over the spindle 52 of the tissue holder 16 and within the cylindrical outer wall 54 thereof. The relative height "f" of the outer cylindrical wall 54 is sufficient to accommodate the two rolls of toilet tissue "T". The entire assembly then may be closed by placing the cylindrical wall 60 of the cover 18 into engagement with the inner step 58 at the top end 56 of the outer sidewall 54 on the tissue holder 16. Thus, the entire assembly defines a continuous erect cylinder with a dome-like cover for conveniently storing and concealing both the brush 12 and two rolls of toilet tissue.

Figure 7:
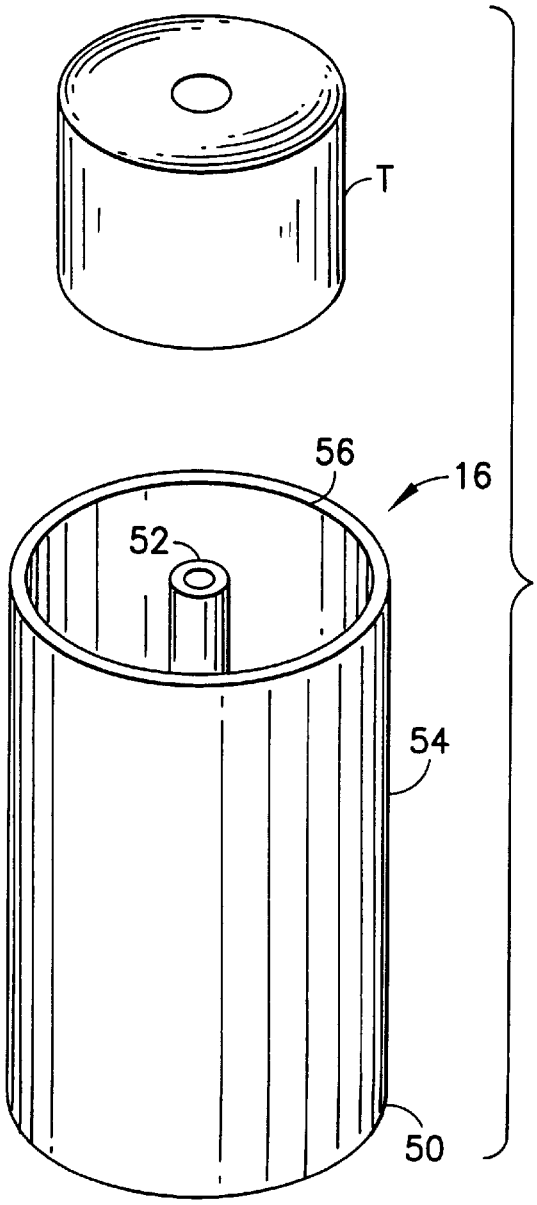
FIG. 7 is an exploded perspective view of rolls of toilet tissue and the toilet tissue support.
Figure 8:
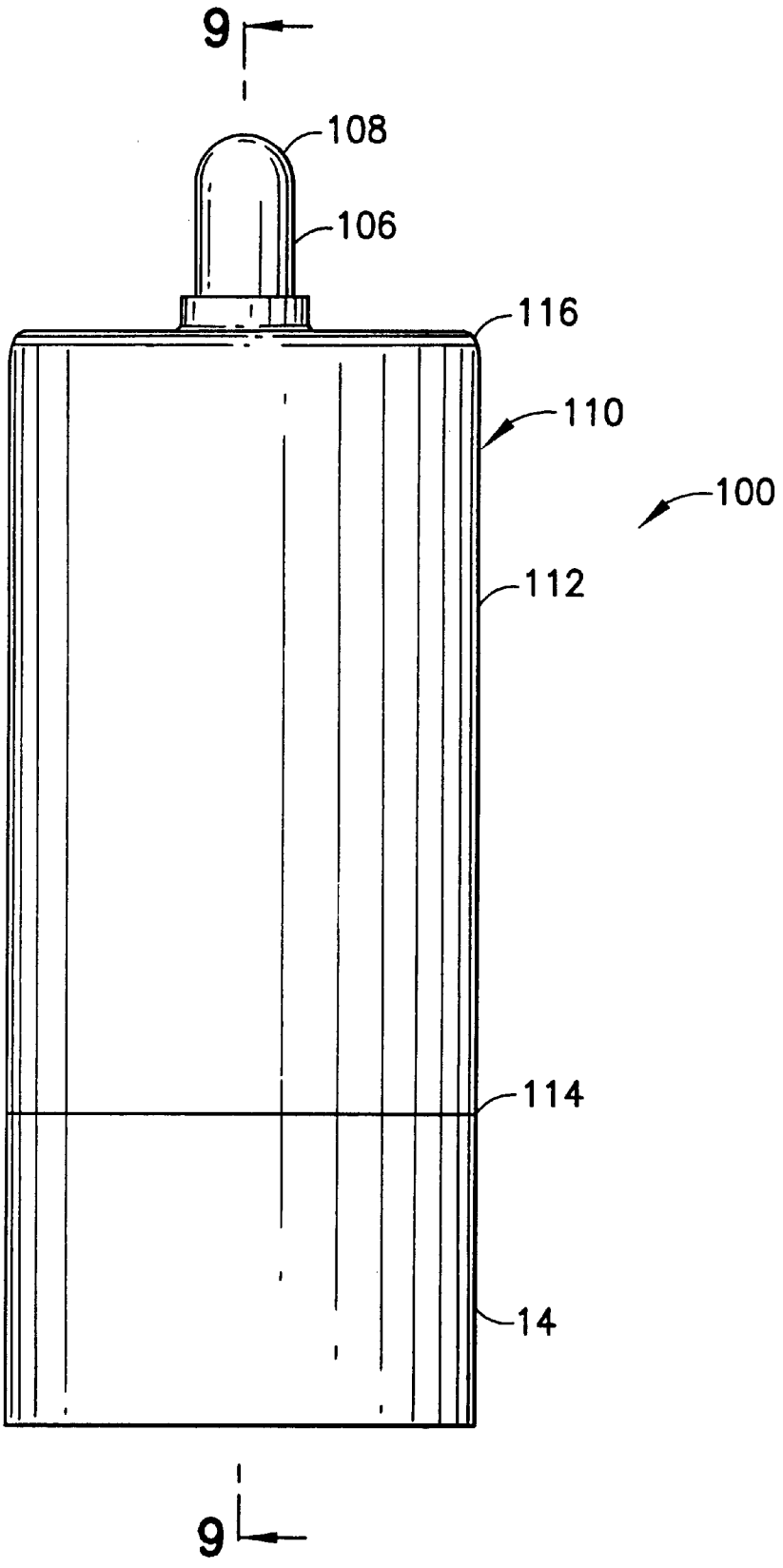
FIG. 8 is a side elevational view of an alternate storage assembly in accordance with the subject invention.
Figure 9:
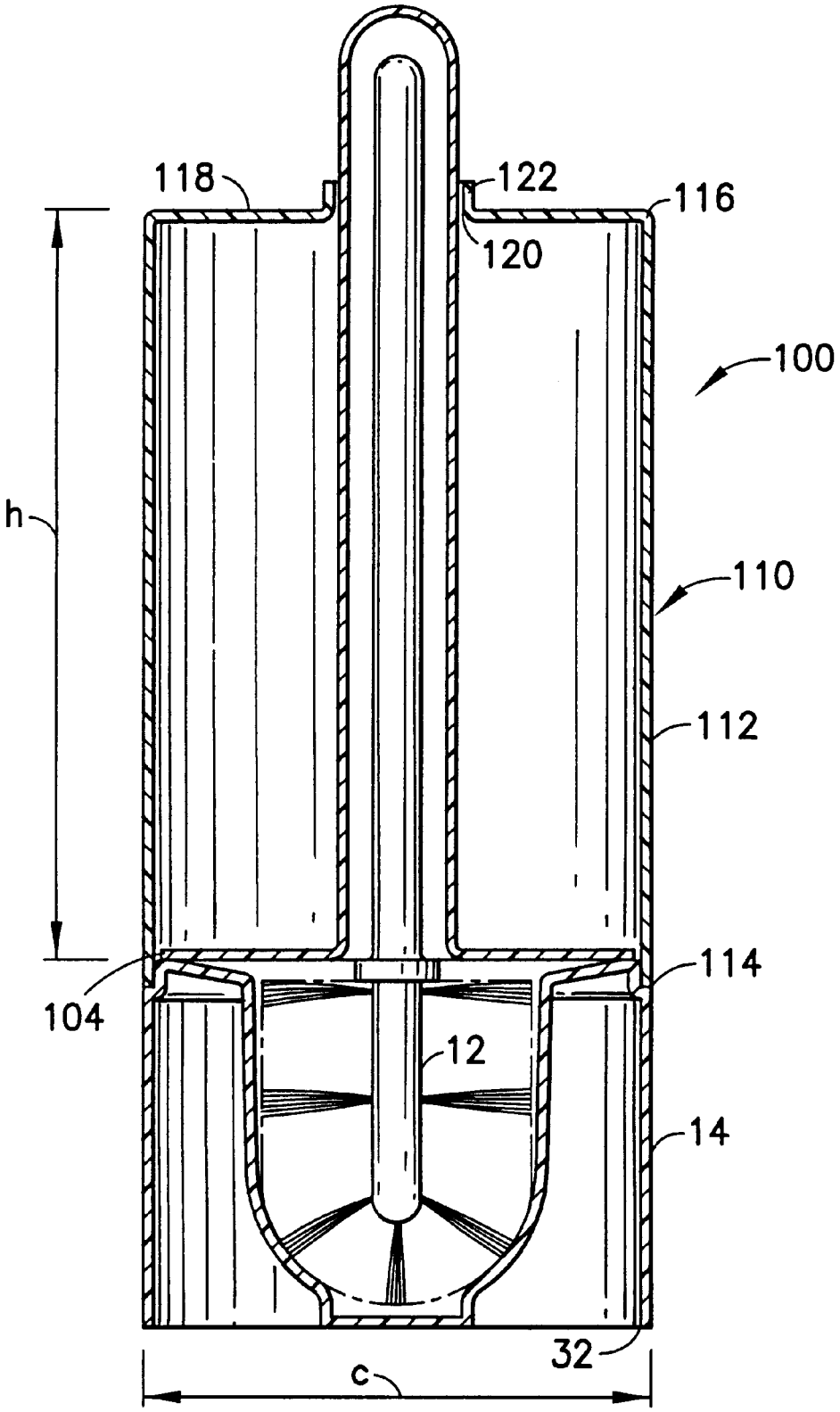
FIG. 9 is a cross-sectional view taken along line 9—9 in FIG. 8.
Figure 10:
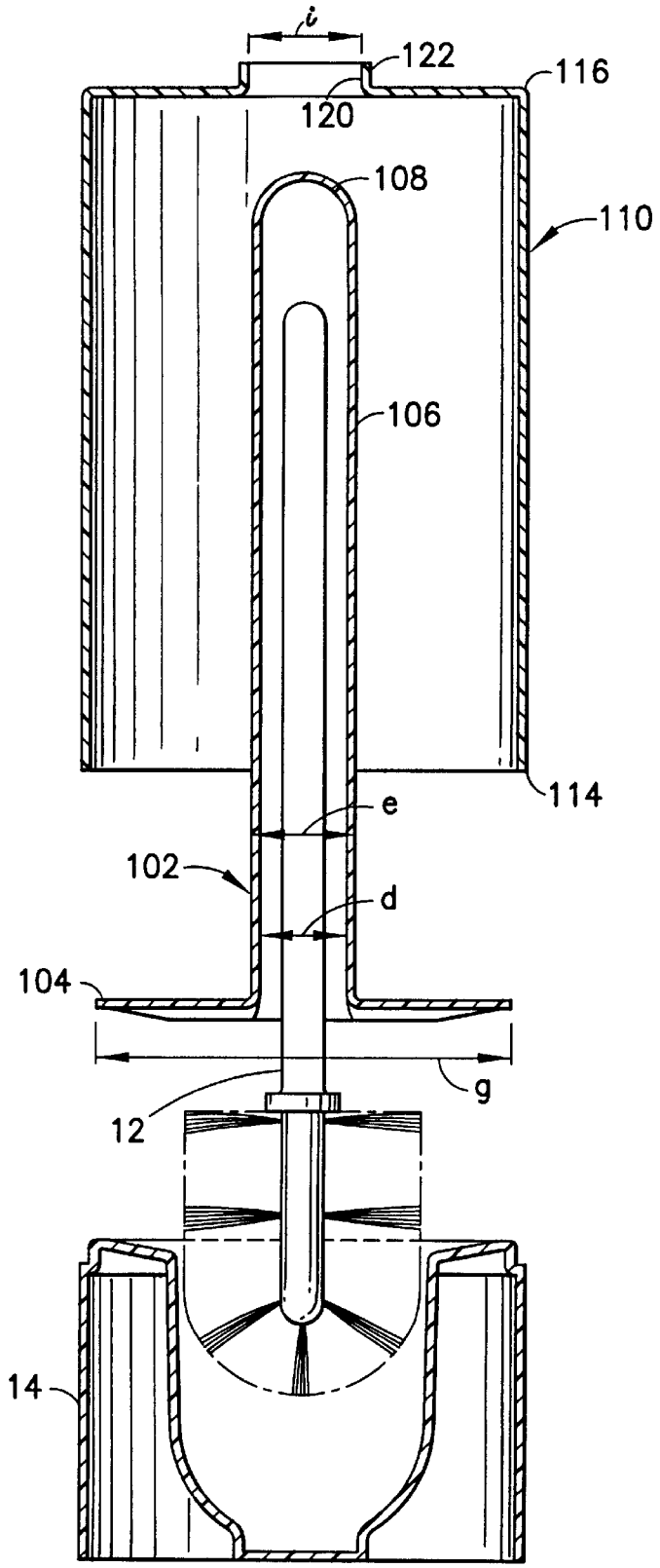
FIG. 10 is an exploded cross-sectional view of the storage assembly of FIGS. 8 and 9.
Figure 11:
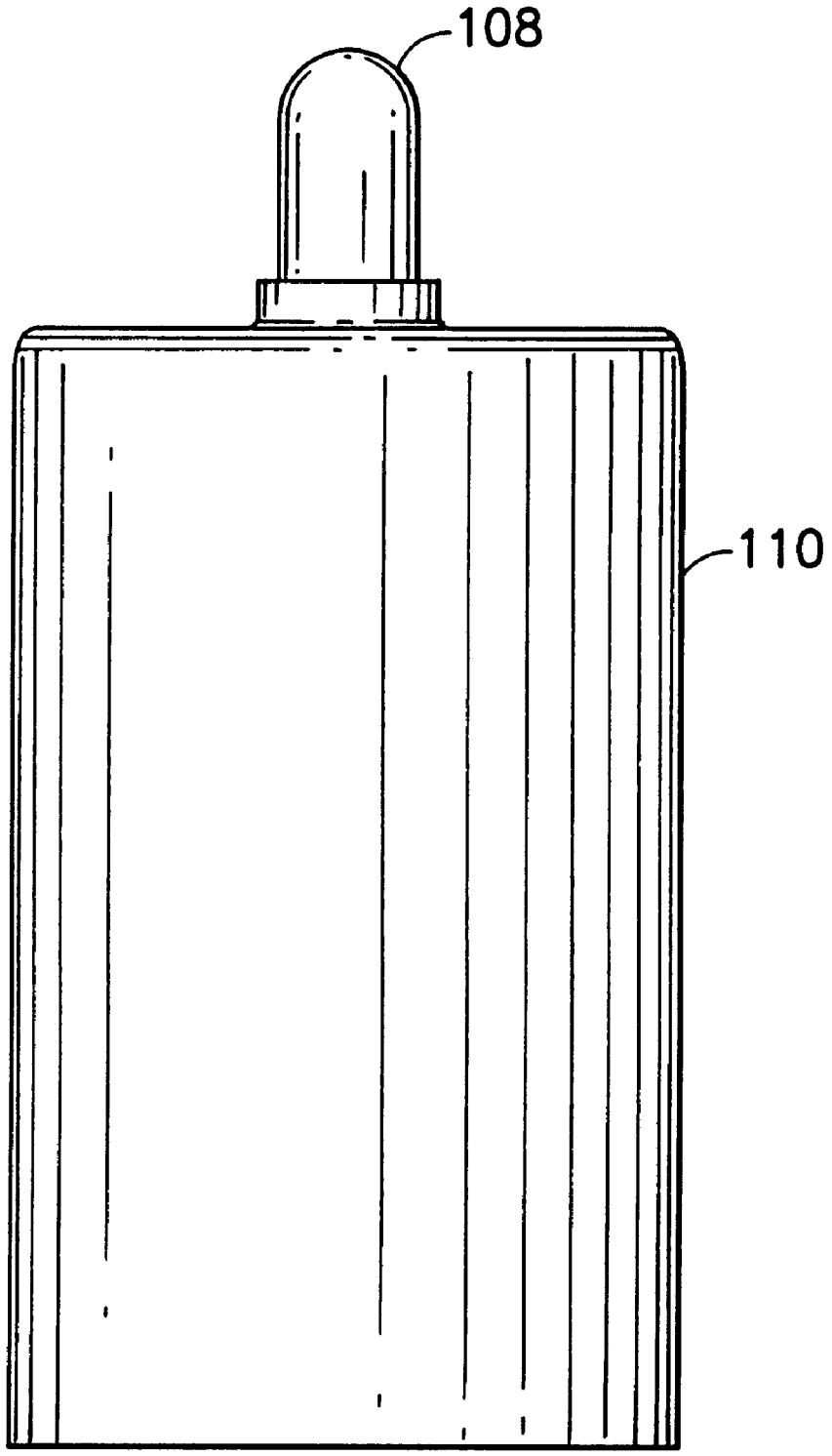
FIG. 11 is a side elevational view of the toilet tissue support and cover of FIG. 10 separately from the brush and brush base.

As noted above, the combination of the bowl brush 12 and the bowl brush base 14 can be supported and used separately if desired, as shown in FIG. 6. Similarly, the combination of the tissue holder 16 and cover 18 can be used separately from the bowl brush base 14 and the bowl brush 12 to provide a separate convenient and attractive storage for two rolls of toilet tissue, as shown in FIG. 7.

A second embodiment of the storage assembly is identified by the numeral 100 in FIGS. 8–11. The assembly 100 includes a bowl brush 12 identical to the bowl brush described with respect to the first embodiment. Additionally, assembly 100 includes a bowl brush base 14 identical to the bowl brush base 14 described with respect to the first embodiment.

The assembly 100 further includes a toilet tissue holder 102 that differs from the toilet tissue holder described and illustrated above with respect to the first embodiment. In particular, the toilet tissue holder 102 includes a generally planar annular bottom wall 104 having an outside diameter "g" which is slightly less than the outside diameter "c" of the outer wall 30 of the bowl brush base 14. The planar annular bottom wall 104 further defines an inside diameter "d" which is greater than the maximum diameter "a" of the handle 20 on the bowl brush 12.

The tissue holder 102 further includes a hollow generally cylindrical spindle 106 extending perpendicularly and concentrically upwardly from the bottom wall 104. The hollow cylindrical spindle 106 has an inside diameter "d" substantially equal to the inside diameter "d" of the hollow spindle 52 on the tissue holder 16 described and illustrated with respect to the first embodiment. Additionally, the spindle 106 further defines an outside diameter "e" substantially equal to the outside diameter of the spindle 52 of the tissue holder 16 on the first embodiment. As noted previously, the outside diameter "e" of the spindle 106 is less than the inside diameter of the tube on which the toilet tissue is wound. The spindle 106 has a top end 108 remote from the bottom wall 104. Unlike the prior embodiment, the top end 108 of the spindle is provided with an arcuate cap fixedly secured thereto. Alternatively, the tissue holder 102 may be formed with the spindle 106 unitarily closed at the top end. The combined length of the spindle 106 and the cap 108 exceeds twice the length of the tube on which the toilet tissue is wound. Thus, two rolls of toilet tissue can be telescoped over the spindle 106 and stacked on the bottom wall 104.

The storage assembly 100 further includes a toilet tissue storage cover 110. The cover 110 is unitarily molded and includes a cylindrical sidewall 112 with a bottom end 114 and a top end 116. The cylindrical sidewall 112 defines an outside diameter "c" substantially equal to the outside diameter of the outer wall 30 on the bowl brush base 14. Additionally, the cylindrical sidewall 112 defines an inside diameter approximately equal to the diameter defined by the step 36 on the bowl brush base 14. As noted previously, this diameter slightly exceeds the diameter of a full roll of toilet tissue. With these respective diameters, the bottom end 114 of the cover 110 can be telescoped over a full roll of toilet tissue and can be telescoped onto the step 36 of the bowl brush base 14. The cylindrical sidewall 112 of the cover 110 defines a length "h" which is slightly greater than twice the length of the tube on which a roll of toilet tissue is wound.

The cover 110 further includes a generally planar annular top wall 118 extending across the top end 116 of the cylindrical sidewall 112. The top wall is formed with a central aperture 120 defining a diameter "i" slightly greater than the outside diameter "e" of the spindle 106 of the tissue holder 102. Additionally, a flange 122 extends slightly upwardly from the top wall 118 at the central aperture 120.

The assembly 100 is used in a manner similar to the assembly 10. In particular, the bowl brush 12 is supported in the base 14 substantially as described above and illustrated in FIG. 6. The tissue holder 106 then is telescoped over the handle 20 of the brush 12. Telescoped movement of the tissue holder 102 over the handle 20 proceeds until the bottom wall 104 rests on the base 114. In the prior embodiment, the handle 120 would project upwardly and beyond the spindle 52. In the subject embodiment, however, the handle 20 is completely enclosed within the spindle 106. Two rolls of toilet tissue then may be mounted over the spindle 106 of the tissue holder 102. The relative dimensions of the toilet tissue are such that the toilet tissue will lie concentrically within the area defined by the outer cylindrical wall 30 of the base 14. Additionally, the cap 108 of the spindle 106 will project upwardly beyond both rolls of toilet tissue. The toilet tissue storage cover 110 then is telescoped over the rolls of toilet tissue mounted on the tissue support 102. This telescoped movement is carried out sufficiently for the bottom end 114 of the cylindrical sidewall 112 of the cover 110 to telescope onto the step 36 of the bowl brush base 14. In this position, the cap 108 at the top of the cylindrical wall 106 of the tissue holder 102 will project through the central aperture 120 of the cover 110.

The assembly 100 can be used in its fully assembled state as described above. Alternatively, the toilet bowl brush 12 and the bowl brush base 14 can be used separately as a first subassembly, while the tissue holder 102 and cover 110 can be used as a second subassembly.

While the invention has been described with respect to preferred embodiments, it is understood that various changes can be made without departing from the scope of the invention as defined by the appended claims. For example, the inner cylindrical wall 52 of the tissue holder 16 in the first embodiment can have a closed top substantially as with the second embodiment. Additionally, the cover 18 of the first embodiment and the top end of the cover 110 in the second embodiment can take other shapes than those illustrated in the figures.

What is claimed is:

1. A storage assembly for a toilet bowl brush and rolls of toilet tissue comprising:

a toilet bowl brush having an elongate handle with opposed ends, an array of bristles extending outwardly at one end of the handle;

a bowl brush base having an upwardly opening receptacle configured for removable supporting engagement of the bristles of the brush such that the handle of the brush is substantially vertically alignable when the bristles are removably supported in the receptacle of the bowl brush base;

a tissue holder having a bottom wall removably supported on the bowl brush base, the bottom wall having a central aperture cross-sectionally larger than the handle of the brush, a hollow spindle projecting centrally from the bottom wall and slidably telescoped over the handle of the brush, the spindle having an outside diameter dimensioned for telescoping rolls of toilet tissue over the spindle; and a cover comprising a sidewall removably telescoped around at least portions of the tissue holder and a top wall extending across the sidewall of the cover for covering rolls of toilet tissue telescoped over the spindle.

2. The assembly of claim 1, wherein the tissue holder has an outer wall extending unitarily from the bottom wall of the tissue holder, the sidewall of the cover being removably engaged with the outer wall of the tissue holder for accessing toilet tissue telescoped over the spindle.

3. The storage assembly of claim 2, wherein the bowl brush base has a top wall surrounding the receptacle and a sidewall extending downwardly from the top wall, the sidewall of the bowl brush base having a step adjacent the top wall, the tissue holder having a lip extending downwardly from the bottom wall and dimensioned for telescoped engagement with the step of the bowl brush base.

4. The storage assembly of claim 2, wherein the outer wall of the tissue holder is cylindrical and substantially concentric with the spindle.

5. The storage assembly of claim 2, wherein the outer wall of the tissue holder and the outer wall of the bowl brush base are cylindrical and have substantially equal outside diameters.

6. The storage assembly of claim 2, wherein the outer wall of the tissue holder includes a step at an end thereof remote from the bottom wall, the side wall of the cover including an engagement portion with a step in nested telescoped engagement with the step of the outer wall of the tissue holder.

7. The storage assembly of claim 1, wherein the top wall of the cover is spherically generated.

8. The storage assembly of claim 1, wherein the handle of the brush defines a selected length, the spindle defining a length less than the length of the handle such that the handle projects upwardly beyond the spindle.

9. The storage assembly of claim 1, wherein the sidewall of the cover is removably engaged with the bowl brush base.

10. The storage assembly of claim 9, wherein the handle of the bowl brush has a selected length, the spindle having a length greater than the length of the handle of the bowl brush, the spindle further having a closed top end remote from the bottom wall such that the spindle covers the handle of the bowl brush.

11. The storage assembly of claim 10, wherein the bowl brush base has a top wall surrounding the receptacle and a sidewall extending downwardly from the top wall, the bottom wall of the tissue holder being supported on the top wall of the bowl brush base and being surrounded by the sidewall of the cover.

12. The storage assembly of claim 10, wherein the top wall of the cover includes a central aperture, the spindle of the tissue holder extending through the aperture in the cover.

* * * * *